US012252835B2

(12) United States Patent
Leibman et al.

(10) Patent No.: US 12,252,835 B2
(45) Date of Patent: Mar. 18, 2025

(54) FLUID INFUSING SYSTEM DRIVEN BY DRYER DRUM

(71) Applicant: Haier US Appliance Solutions, Inc., Wilmington, DE (US)

(72) Inventors: Alexander B. Leibman, Prospect, KY (US); Venkata Chakradhar Rangu, Hyderabad (IN); Paul Owen Davis, Prospect, KY (US); Jay Pareshbhai Shinde, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 828 days.

(21) Appl. No.: 17/365,320

(22) Filed: Jul. 1, 2021

(65) Prior Publication Data

US 2023/0002954 A1 Jan. 5, 2023

(51) Int. Cl.

| | |
|---|---|
| ***D06F 58/00*** | (2020.01) |
| ***D06F 58/04*** | (2006.01) |
| ***D06F 58/20*** | (2006.01) |
| ***D06F 58/44*** | (2020.01) |
| *D06F 105/38* | (2020.01) |

(52) U.S. Cl.

CPC ..... *D06F 58/203* (2013.01); *D06F 58/04* (2013.01); *D06F 58/44* (2020.02); *D06F 2105/38* (2020.02)

(58) Field of Classification Search

CPC ..... D06F 58/203; D06F 58/04; D06F 58/44; D06F 2105/38; D06F 58/02; D06F 58/20; F04D 13/022

USPC ..... 34/357; 106/264

See application file for complete search history.

(56) References Cited

U.S. PATENT DOCUMENTS

| | | | | |
|---|---|---|---|---|
| 3,108,465 | A | 10/1963 | Bochan | |
| 4,467,627 | A * | 8/1984 | Platt | D06F 39/085 68/17 R |
| 6,571,993 | B2 | 6/2003 | Graham | |
| 8,984,767 | B2 | 3/2015 | Grunert | |
| 11,898,294 | B2 * | 2/2024 | Kim | D06F 39/022 |
| 2004/0000177 | A1 * | 1/2004 | Maeng | D06F 39/02 68/17 R |
| 2005/0183208 | A1 * | 8/2005 | Scheper | D06F 43/02 68/17 R |
| 2006/0107547 | A1 * | 5/2006 | Baier | D06F 58/08 34/601 |
| 2011/0023241 | A1 * | 2/2011 | Lim | D06F 58/44 68/200 |

(Continued)

FOREIGN PATENT DOCUMENTS

| | | |
|---|---|---|
| CA | 2380152 C | 2/2001 |
| CA | 2485865 C | 12/2003 |

(Continued)

*Primary Examiner* — John P McCormack

(74) *Attorney, Agent, or Firm* — Dority & Manning, P.A.

(57) ABSTRACT

A dryer appliance includes an impeller assembly for drawing a fluid from a reservoir assembly and directing the fluid into a drying chamber to treat articles for drying. The impeller assembly includes a spindle that drives the impeller. The spindle is rotated by a roller which itself is rotated through contact with the dryer appliance's rotating drum. The reservoir assembly is filled with a clothing treatment liquid. Negative pressure generated by operation of the impeller assembly draws fluid from the reservoir through a siphon and the fluid is delivered to a fluid distribution element directed into the drying chamber.

19 Claims, 7 Drawing Sheets

(56) References Cited

U.S. PATENT DOCUMENTS

| | | | | |
|---|---|---|---|---|
| 2011/0067456 | A1* | 3/2011 | Quandt | D06F 39/02 68/12.18 |
| 2016/0138209 | A1* | 5/2016 | Kitayama | D06F 58/20 34/131 |
| 2016/0215438 | A1 | 7/2016 | Chernetski | |
| 2018/0371679 | A1* | 12/2018 | Leibman | D06F 60/00 |

FOREIGN PATENT DOCUMENTS

| | | | |
|---|---|---|---|
| EP | 1907620 | B1 | 11/2010 |
| EP | 2141280 | B1 | 3/2014 |
| EP | 2518204 | B1 | 4/2015 |
| EP | 2342378 | B1 | 6/2016 |
| EP | 1564325 | B1 | 4/2018 |
| ES | 2316580 | T3 | 4/2009 |
| KR | 20070063997 | A | 6/2007 |

* cited by examiner

FLUID INFUSING SYSTEM DRIVEN BY DRYER DRUM

FIELD OF THE INVENTION

The present subject matter relates generally to dryer appliances, or more specifically, to systems for using the rotation of dryer drum to drive an impeller to infuse a fluid into the drum for treatment of clothing therein.

BACKGROUND OF THE INVENTION

Dryer appliances generally include a cabinet having a rotating drum with a chamber therein to permit drying of articles of clothing and other laundry. Demand for the ability to treat clothing with various desirable or protective liquids is rising. In particular, demand for the ability to introduce a scent to dry clothing is growing. Additionally, there is a demand to treat dry clothing with various protective coatings, such as with liquids providing ultraviolet light protection, anti-microbial liquids, or other medicinal liquids.

Conventionally, clothing is treated, for example with stain removers and the like, prior to washing. However, this method is ineffective for treating cloths with scent, ultraviolet protection, anti-microbial protection, and other similar medicinal liquids because washing the clothes will remove the intended application. Such treatments must be applied to dry clothing after the washing cycle is complete. Currently, the application of such liquids would not involve the use of a dryer, but would instead be done manually on each item of clothing individually, resulting in a large investment of time and treatment materials.

Accordingly, a dryer appliance capable of applying a scent or other fluid to coat dry clothing is desirable. It is further desirable that such an appliance would operate with minimal additional energy requirements. It is still further desirable that such an appliance could conserve the amount of treatment materials required to accomplish the desired type of clothing treatment.

BRIEF DESCRIPTION OF THE INVENTION

Advantages of the invention will be set forth in part in the following description, or may be apparent from the description, or may be learned through practice of the invention.

In one exemplary embodiment, a dryer appliance is provided, including a cabinet, a rotatable drum within the cabinet defining a chamber for the receipt of articles for drying, a rotatable roller, an impeller assembly, a reservoir assembly, and a fluid distribution element for dispensing fluid into the chamber. The rotatable roller is in contact with the drum and oriented such that rotation of the drum causes rotation of the roller. The impeller assembly further includes an impeller, a housing substantially enclosing the impeller, and a spindle. The housing has an inlet and an outlet, wherein rotation of the impeller generates negative pressure at the inlet and positive pressure at the outlet. The spindle has a first end and a second end, the first end of the spindle in contact with the roller such that rotation of the roller causes rotation of the spindle. At least a portion of the second end of the spindle extends into the housing and attaches to the impeller such that rotation of the spindle causes rotation of the impeller. The reservoir assembly is in fluid communication with the inlet of the housing of the impeller assembly. The fluid distribution element is in fluid communication with the outlet of the housing of the impeller assembly.

In another exemplary embodiment, a dryer appliance is provided. The appliance includes a cabinet, a rotatable drum within the cabinet defining a chamber for the receipt of articles for drying, a rotatable roller, an impeller assembly, a reservoir assembly. The rotatable roller is in contact with the drum and oriented such that rotation of the drum causes rotation of the roller. The impeller assembly further includes an impeller, a housing substantially enclosing the impeller, and a spindle. The housing has an inlet and an outlet, wherein rotation of the impeller generates negative pressure at the inlet and positive pressure at the outlet. The spindle has a first end and a second end, the first end of the spindle in contact with the roller such that rotation of the roller causes rotation of the spindle. At least a portion of the second end of the spindle extends into the housing and attaches to the impeller such that rotation of the spindle causes rotation of the impeller. The reservoir assembly is in fluid communication with the inlet of the housing of the impeller assembly. The reservoir assembly further includes a bottom surface, one or more side surfaces extending vertically upward around a perimeter of the bottom surface to retain a liquid, an opening in the bottom surface; and a hollow siphon attached to the bottom surface, at least a portion of the siphon extending vertically upward from the bottom surface. The siphon covers the opening such that fluids can flow from the reservoir assembly, through the hollow siphon, and through the opening in the bottom surface of the reservoir assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
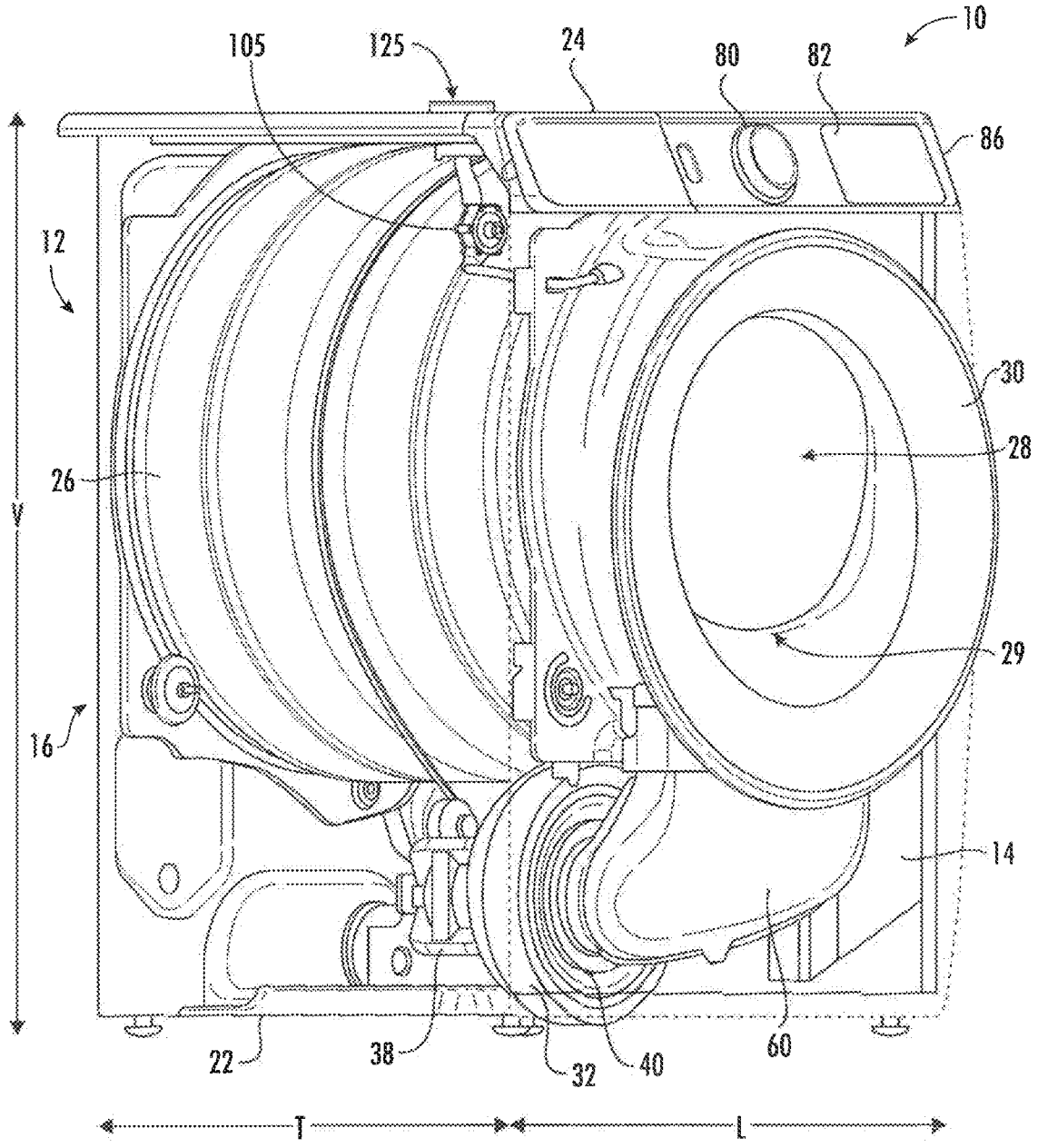
FIG. 1 provides a perspective view of a dryer appliance according to an exemplary embodiment of the present disclosure with portion of a cabinet of the exemplary dryer appliance removed or transparent to reveal certain components of the exemplary dryer appliance.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
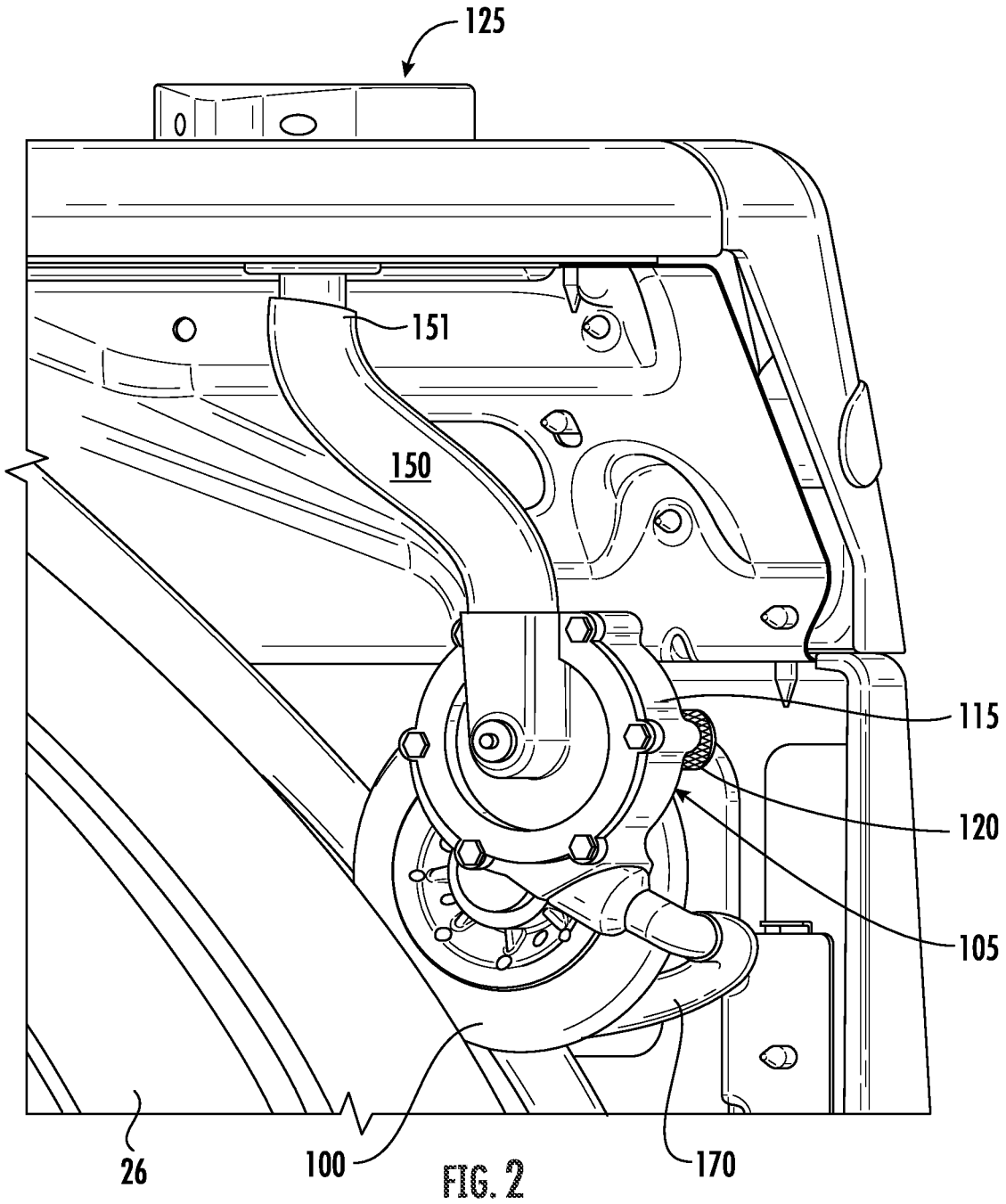
FIG. 2 provides a perspective view of an exemplary impeller assembly, reservoir assembly, and fluid distribution path.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other appliances, including front or top-loaded washer appliances, combination washer/dryer appliances, ovens, dishwashers, refrigerators, and microwave ovens may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14 and a rear panel 16 spaced apart along the transverse direction T, a first side panel 18 and a second side panel 20 spaced apart along the lateral direction L, and a bottom panel 22 and a top surface or cover 24 spaced apart along the vertical direction V. Within cabinet 12 is a container or drum 26 which defines a chamber 28. Chamber 28 defines a front opening 29 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. Rotation of drum 26 is driven by drum motor 27. A door 30 is rotatably mounted to cabinet 12 for providing selective access to drum 26. Door 30 rotates between an open position and a closed position. When in the closed position, door 30 covers front opening 29.

As best shown in FIG. 2, an air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly in order to dry damp articles disposed within chamber 28 of drum 26. The heating assembly includes a heater that is in thermal communication with chamber 28. For instance, the heater may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly due to air handler 32 urging such ambient air into entrance 54. Such ambient air is heated within the heating assembly and exits as heated air. Air handler 32 draws such heated air to drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. Air further flows through air handler 32 and to the exhaust conduit.

The internal air is exhausted from dryer appliance 10 via the exhaust conduit. In some embodiments, an external duct is provided in fluid communication with the exhaust conduit. For instance, the external duct may be attached (e.g., directly or indirectly attached) to cabinet 12 at rear panel 16. Any suitable connector (e.g., collar, clamp, etc.) may join the external duct to the exhaust conduit. In residential environments, the external duct may be in fluid communication with an outdoor environment (e.g., outside of a home or building in which dryer appliance 10 is installed). During a dry cycle, internal air may thus flow from the exhaust conduit and through the external duct before being exhausted to the outdoor environment.

In exemplary embodiments, trap duct 60 may include a filter portion which includes a screen filter or other suitable device for removing lint and other particulates as internal air is drawn out of chamber 28. The internal air is drawn through the filter portion by air handler 32 before being passed through the exhaust conduit. After the articles have been dried (or a drying cycle is otherwise completed), the articles are removed from drum 26, e.g., by accessing chamber 28 by opening door 30. The filter portion may further be removable such that a user may collect and dispose of collected lint between drying cycles.

One or more selector inputs 80, such as knobs, buttons, touchscreen interfaces, etc., may be provided on a front control panel 82 and may be in communication with a processing device or controller 84. Signals generated in controller 84 operate motor 38 and other system components in response to the position of selector inputs 80. Additionally, a display 86, such as an indicator light or a screen, may be provided on front control panel 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation profiles of dryer appliance 10 based on one or more temperatures detected by the temperature sensors or air flow measurements from the airflow sensors.

Figure 3:
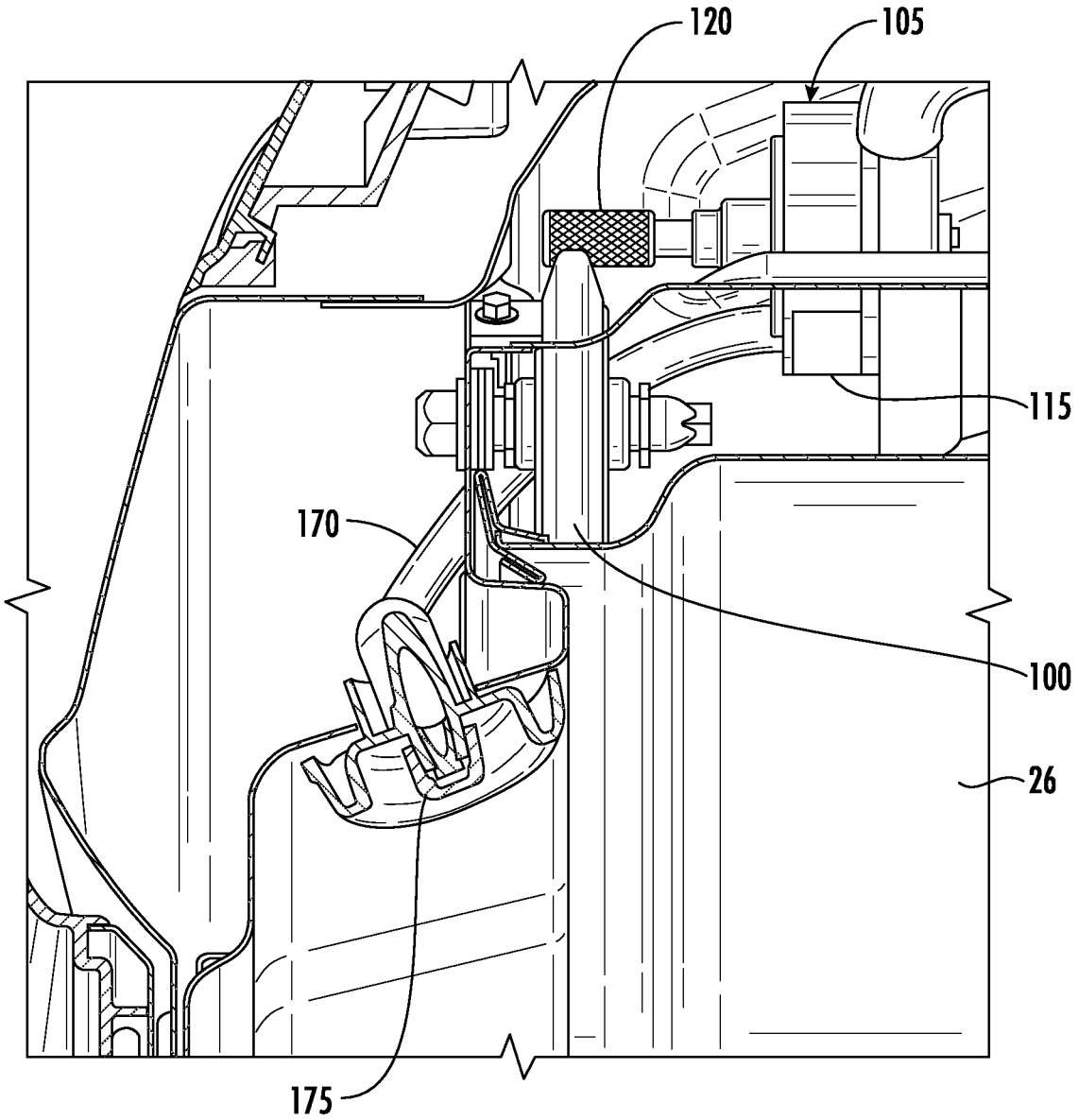
FIG. 3 provides a side view of an exemplary impeller assembly, roller, nozzle, and other elements of an exemplary dryer appliance.

Referring now specifically to FIGS. 2 and 3, dryer appliance 10 includes a rotatable roller 100. Roller 100 rotates about a central axis that is substantially parallel to the central axis about which drum 26 rotates. Roller 100 may be positioned in physical contact with an outer surface of drum 26 such that the rotation of drum 26 causes roller 100 to rotate in the opposite direction. Roller 100 may be significantly smaller in diameter than drum 26. As a result, roller 100 rotates at a significantly faster velocity than drum 26.

Figure 4:
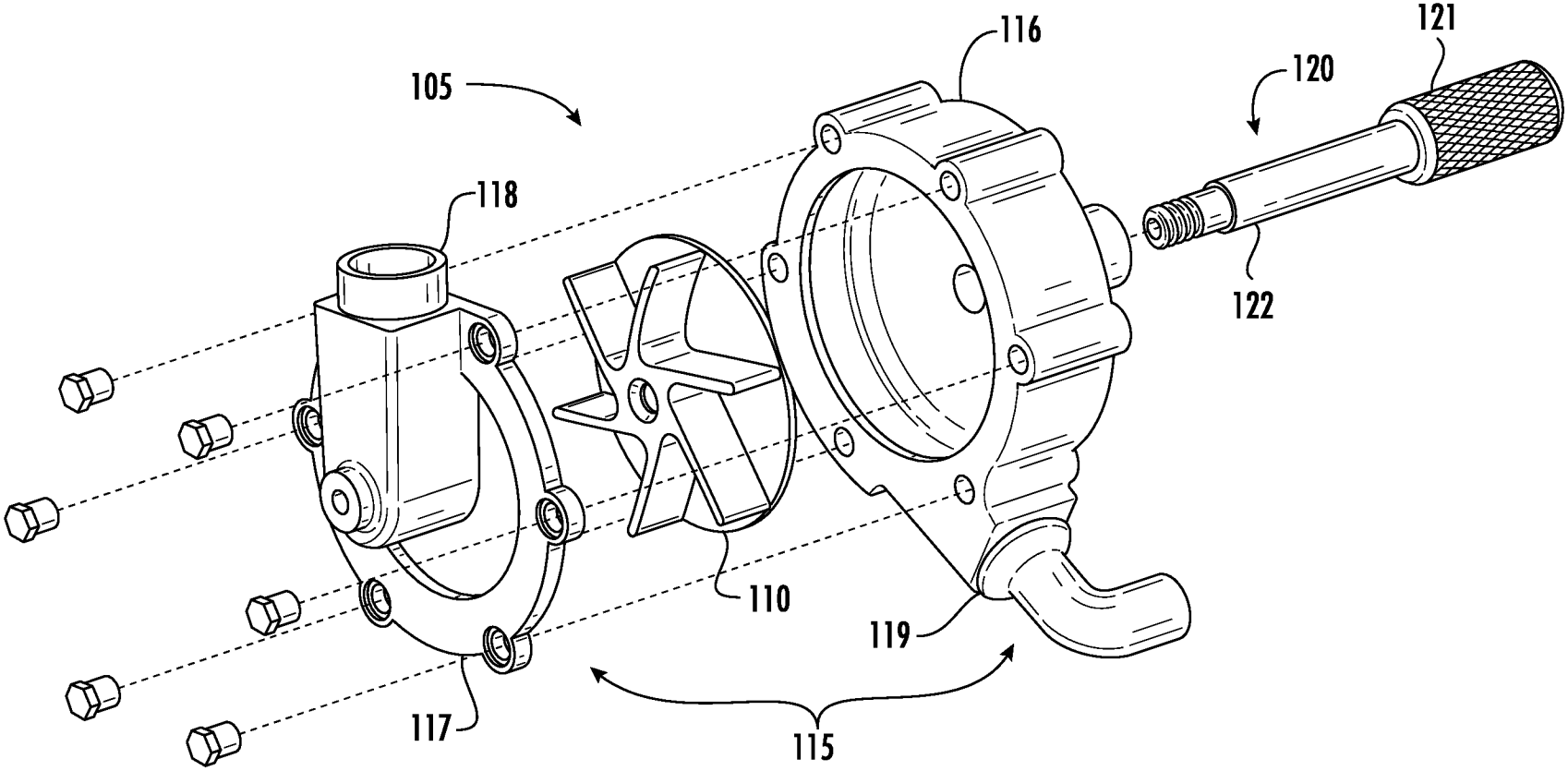
FIG. 4 provides an exploded view of components of an exemplary impeller assembly.

Dryer appliance 10 may further include an impeller assembly 105. FIG. 4 provides an exploded view of an exemplary embodiment of impeller assembly 105. Impeller assembly 105 may include an impeller 110, a housing 115, and a spindle 120. In the embodiment of FIG. 4, impeller 110 is a semi-open vortex impeller have a circular rear plate and vanes extending at an angle from the cylindrical center. The particular design of impeller 110, as shown in the embodiment of FIG. 4, is not central to the invention. Rather, impeller 110 may take many forms, as would be understood by one of ordinary skill in the art. Impeller 110 functions to pump fluid through they system, as detailed below, and thus any impeller appropriate to this purpose may be used in accordance with the present disclosure.

An embodiment of housing 115 is provided in FIG. 4. Housing 115 may include a housing body 116 and a housing cover 117. Housing body 116 may be generally cylindrical in shape. The cylindrical shape may be formed by a back and one or more side walls extending from the perimeter of the back wall, thus forming a hollow cavity sized to receive impeller 110. The side walls of housing body 116 may include a series of holes spaced apart from one another to allow housing body 116 to be connected to housing cover 117, as described herein. An outlet 119 may be formed in the one or more side walls to permit fluid to exit housing 115.

Housing cover 117 may generally shaped as a circular disc, as shown in the embodiment of FIG. 4. Holes for connecting housing cover 117 may be evenly spaced around the perimeter of the disc in a pattern corresponding to the hole of housing body 116. Housing cover 117 may be positioned against the top of the side walls of housing body 116, thus substantially enclosing impeller 110 within housing assembly 115. While it is desirable that impeller 110 be fully enclosed within housing assembly 115, it is not strictly necessary, as impeller assembly 105 will continue to operate even if gaps are present in housing assembly 115. Such gaps, however, would decrease the efficiency with which fluids are passed through the housing assembly. At least a majority of the fluid entering the housing assembly should exit the housing assembly through its intended outlet, as further described below. Housing body 116 and housing cover 117 may be secured together by placing bolts through the aligned openings in each of those components and tightening nuts to the opposite end of each bolt. However, the housing body 116 and housing cover 117 need not be secured by nuts and bolts. One of ordinary skill in the art will recognize that any connection means known in the art, including screws, adhesives, clamps, and the like, that serve to secure these components together would fall within the scope of the invention.

As also shown in the embodiment of FIG. 4, housing cover 117 may further include an inlet 118. Inlet 118 may simply be an opening in a conduit that intersects the cylindrical disc of housing cover 117, permitting fluid to pass through inlet 118 and housing cover 117 and into the cavity formed by housing body 116. Impeller 110 may be oriented within the cavity such that the rear plate of impeller 110 is on the opposite side of inlet 118, such that the vanes of impeller 110 extend in the direction of inlet 118.

Housing assembly 115 may be secured in place by means of a bracket attached on one end to a fixed element within cabinet 12 and on the other end to housing cover 117 or housing body 116. The bracket may be secured to housing assembly 115 in any known manner, such as screws, nuts and bolts, rivets, or the like. Attachment of the bracket may take advantage of the connection means employed for connecting housing body 116 to housing cover 117 or may use entirely separate connection means.

The skilled artisan will recognize that the above descriptions of shape, connection means, and positioning of the inlet and outlet of housing body 116 and housing cover 117 are merely illustrative of one embodiment of housing assembly 115 and that other arrangements consistent with the disclosure herein may equally fall within the scope of the invention. For example, in alternative embodiments, the inlet may be formed on the housing body and the outlet may be formed on the housing cover. In still other embodiments, the housing body may lack side walls, which side walls may be included on the housing cover, thus permitting the impeller to reside in a cavity of the housing cover. In still other embodiments, both the housing body and the housing cover may form side walls that together form the cavity in which the impeller resides. In still further embodiments, housing cover and housing body may form a single, integrated component, with or without an access port. These and other embodiments will be readily apparent to one of ordinary skill in the art and all fall within the scope of the intended invention.

Housing assembly 115 further includes a spindle 120. As shown in the embodiment of FIG. 4, spindle 120 may comprise a first end having spindle head 121 and a second end having spindle body 122. Spindle body 122 may be a cylindrical element, at least a portion of which passes through a central opening in housing body 116 and attaches to impeller 110. Spindle body 122 may attach to the rear plate of impeller 110 in some embodiments. In other embodiments spindle body may extend through a central opening in impeller 110 and may be connected on both ends, or even along the entirety of the intersection between spindle body 122 and impeller 110. In still other embodiments, spindle body 122 and impeller 110 may form a single, integrated component. Spindle body 122 may be attached to impeller 110 in any known, conventional manner, including the use of a pin, screws, nuts and bolts, welding, and the like, such that rotation of spindle 120 causes rotation of impeller 110. Spindle head 121 may be attached or integral to spindle body 122, as shown in the embodiment of FIG. 4. In the preferred embodiment, spindle head 121 is cylindrical in shape and is disposed entirely outside of housing 115.

Impeller assembler 115 may be position such that spindle head 121 is in direct contact with roller 100, such that rotation of roller 100 causes rotation of spindle 120, which may have an axis of rotation parallel to the axis of rotation of roller 100. As previously explained, the rotation of roller 100 is caused by the rotation of drum 26. Thus, the rotation of drum 26 drives the rotation of roller 100, which drives the rotation of spindle 120. Because spindle 120 is attached to impeller 110, rotation of drum 26 thus results in rotation of impeller 110. Again, as previously noted, the diameter of drum 26 may be significantly larger than the diameter of roller 100, thus resulting is significantly faster rotation of roller 100 as compared to drum 26. Similarly, spindle 120 may have a significant smaller diameter than roller 100 and thus may rotate at a significantly greater speed than roller 100. Because spindle 120 is attached to impeller 110, they share the same rate of rotation. As a consequence of these relationships, the rotation speed of the impeller may be controlled by the sizing of the roller and spindle selected. The greater the size disparities between the diameters of these components and that of the drum, the greater the rate of rotation of the impeller will be. The rate of rotation of impeller 110 may also be controlled, in part, by the rate of rotation of drum 26, however, this rate of rotation is generally governed by the functional demands of the dryer in drying articles of clothing and other laundry.

Accordingly, normal operation of dryer appliance 10 involves rotation of drum 26, which drives rotation of impeller 110 in impeller assembly 115. As previously mentioned, the vanes of impeller 110 extend from a central portion of impeller 110 at an angle. In particular, in the preferred embodiment, the vanes of impeller 110 may extend at angle in the direction of outlet 119 of housing body 116 and away from inlet 118 of housing cover 117. As such, rotation of impeller 110 generates a negative pressure at inlet 118 and a positive pressure at outlet 119.

Figure 5:
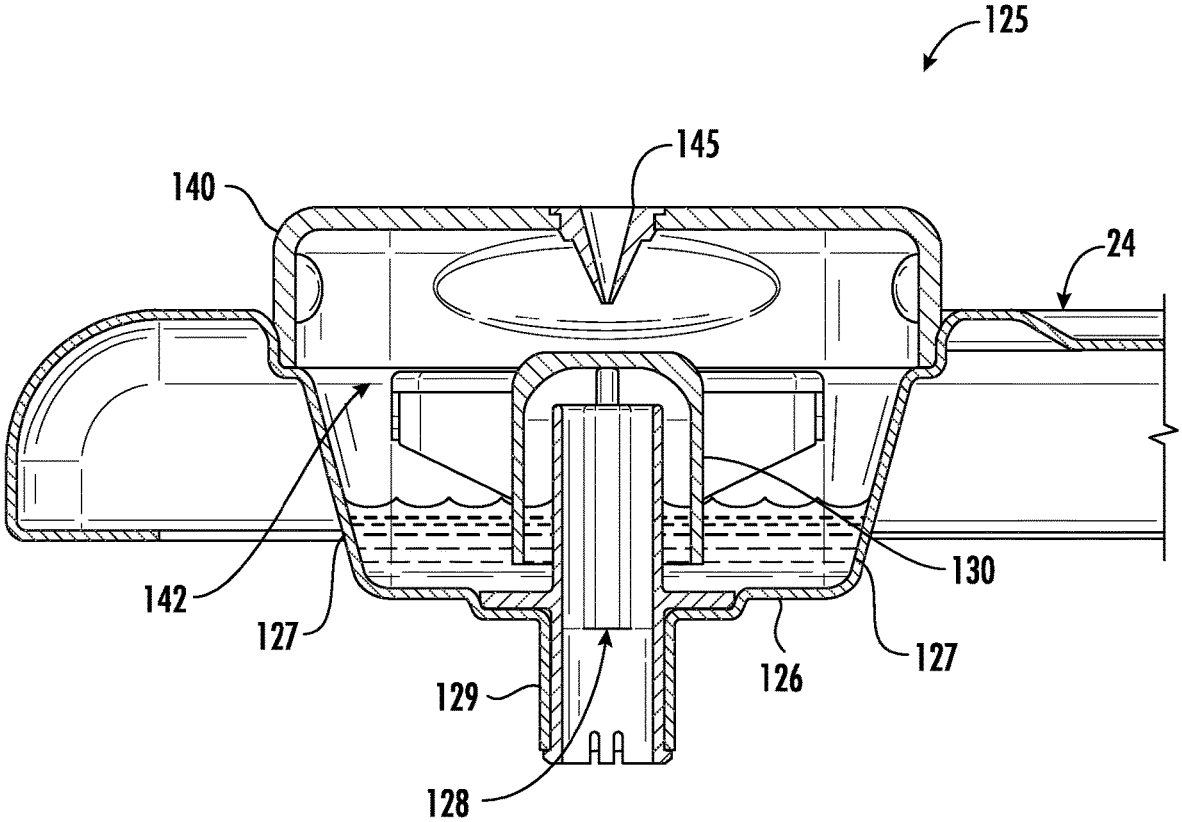
FIG. 5 provides a side view of an exemplary reservoir assembly.

Dryer appliance 10 may further include a reservoir assembly 125 for retaining clothing treatment fluids. In the preferred embodiment, as shown in FIG. 5, reservoir assembly 125 includes a bottom surface 126 and one or more side surfaces 127 extending vertically upward around the perimeter of bottom surface 126. Together, bottom surface 126 and side walls 127 form a cup-like cavity for retaining liquids. In this embodiment, bottom surface 126 is circular and a single side wall 127 forms a hollow cylinder extending upward. In alternative embodiments, however, these elements may take any shape consistent with the present disclosure. For example, bottom surface 126 may be rectangular and four side walls 127 may extend upward from each side of bottom surface 126. Other arrangements for retaining liquids will be readily apparent to those skilled in the art and are intended to fall within the scope of the present disclosure.

As further illustrated in the embodiment of FIG. 5, bottom surface 126 of reservoir assembly 125 includes an opening 128 between the top and bottom of bottom surface 126. A hollow siphon 129 is attached to bottom surface 126 and at least a portion of siphon 129 extends vertically upward from bottom surface 126. Siphon 129 is positioned covering the opening 128 in bottom surface 126. As used here, the phrase covering the opening is meant broadly to encompass not only extending over the top of the opening, but also in the sense of occupying the opening, or otherwise preventing liquid in reservoir assembly 125 from passing through opening 128 without first passing through siphon 129, as discussed below. For example, in the preferred embodiment, siphon 129 attaches to bottom surface 126 via a flange situated below bottom surface. A portion of siphon 129 then extends though opening 128, occupying the entirety of opening 128, and extends vertically upward above bottom surface 126. Thus, siphon 129 covers opening 128, as that term is used here. In alternative embodiments, siphon 129 may mount to bottom surface 126 via a flange above bottom surface 126, which likewise covers opening 128. In yet other embodiments, no flange is used and siphon 129 is attached to bottom surface 126 by virtue of a gasket and compression. Other means of attaching siphon 129 to bottom surface 126 will be apparent to one of ordinary skill.

As previously noted, and as illustrated in FIG. 5, siphon 129 is hollow, thus forming a passageway for fluids to flow from reservoir assembly 125 through siphon 129 and through opening 128 in bottom surface 126, thereby exiting reservoir assembly 125. In some embodiments of the present invention, such as that shown in FIG. 5, this fluid may be a liquid. In other embodiments, discussed below, the fluid may be a gas. In embodiments where it is desirable to draw liquids from reservoir assembly 125, reservoir assembly 125 may further include a siphon cap 130 (see FIG. 5). Siphon cap 130 comprises a top surface 131 disposed above the siphon and one or more side surfaces 132 extending downward from a perimeter of top surface 131. In the preferred embodiment, the one or more side surface 132 form a cylinder, however this shape is not required. In alternative embodiments, top surface 131 may be rectangular and the one or more side surfaces 132 may be four side surfaces, one of each extending from each side of top surface 131. While other configurations fall within the scope of the present disclosure, each configuration includes one or more side surfaces 132 extending downward from top surface 131 such that the one or more side surfaces 132 extend around a portion of siphon 129, leaving a narrow gap between the two. Generally, it is preferred that the shape of siphon cap 130 match the shape of the vertically extending portion of siphon 129. In alternative embodiments, appropriate for applications in which the fluid to be distributed is a gas, reservoir assembly 125 may omit siphon cap 130.

In the embodiment of FIG. 5, reservoir assembly 125 may optionally include a lid 140. For embodiments of reservoir assembly 125 which lack siphon cap 130, lid 140 is necessary. Lid 140 is situated above the one or more side walls 127. Lid 140 may further be situated outside of cabinet 12 such that at least a portion of reservoir assembly 125 extends through an opening 142 in top surface 24 of cabinet 12. In alternative embodiments, lid 140 may set in a recess in top surface 24 or even recessed below top surface 24, so long as lid 140 remains accessible. Lid 140 may be movable for selectively accessing and adding liquid to the reservoir assembly. For example, lid 140 may pivot between an open and closed position. In other embodiments, lid 140 may be entirely detachable. In still other embodiments, lid 140 may screw or snap onto an extension that rises above top surface 24. In yet other embodiments, only a portion of lid 140 may be movable. Still other alternatives for movable lid 140 will be apparent to the skilled artisan that would permit selective access to reservoir assembly 125.

Where present, lid 140 may include a check valve 145 disposed through a surface of lid 140. Check valve 145 may take the form of a duckbill valve or other similar one-way pressure release valve. As further described herein, negative pressure generated by impeller assembly 105 creates a vacuum within at least a portion of reservoir assembly 125. Where such vacuum extends to the entire cavity of reservoir assembly 125, for example if no treating fluids are present, it is necessary to relieve the pressure differential between the inside and outside of reservoir assembly 125 to prevent damage to the components. Check valve 145 achieves this pressure relief by permitting air to pass through lid 140 once the pressure differential reaches a particular point.

Figure 6:
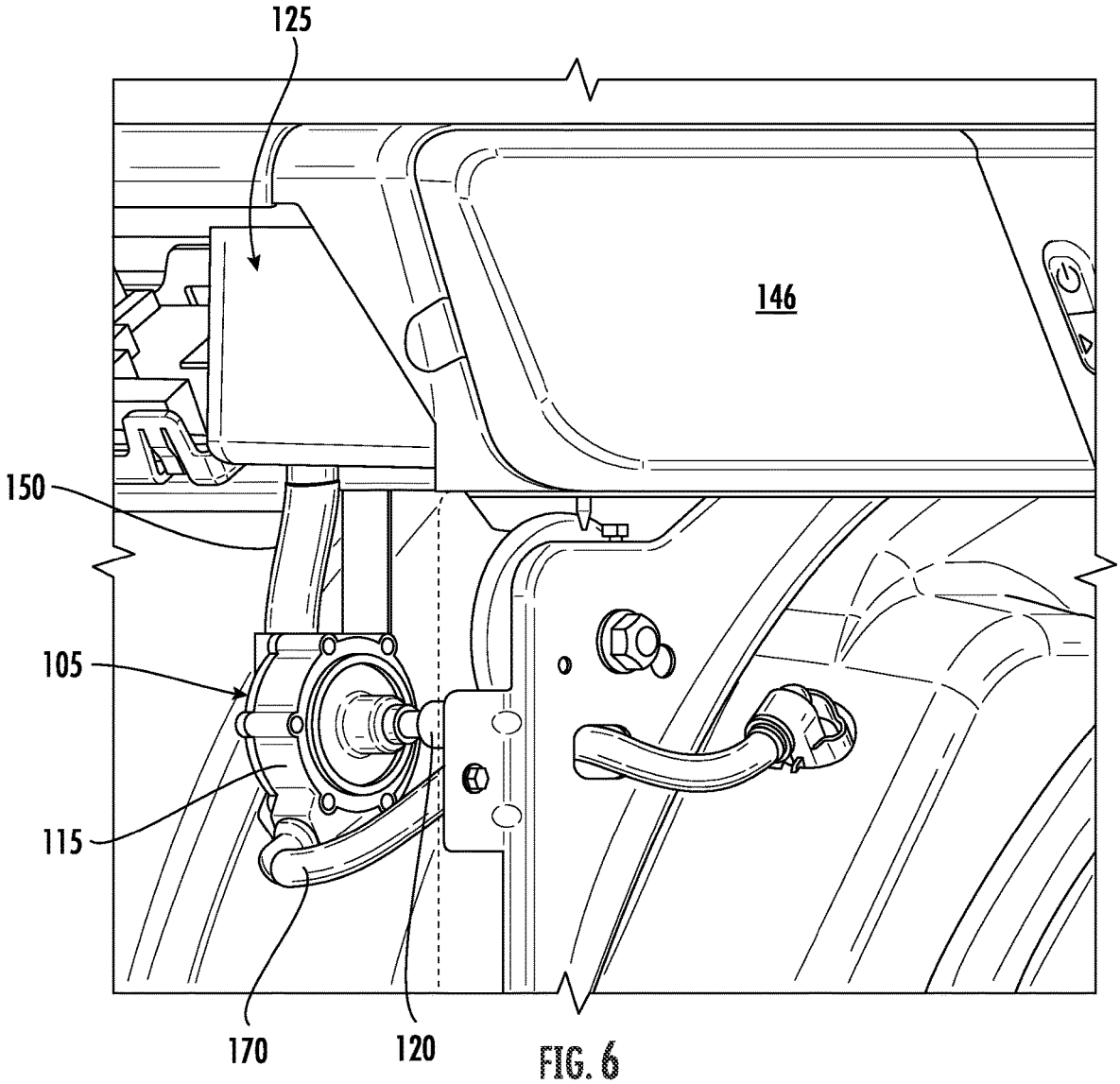
FIG. 6 provides a perspective view of an exemplary reservoir assembly in an alternative embodiment in which reservoir assembly is a drawer.

In alternative embodiments, reservoir assembly 125 may constitute a sliding drawer, as shown in FIG. 6, where in reservoir assembly slides between a closed position, in which most or all of reservoir assembly 125 is contained within cabinet 12, and an open position, in which at least a portion of reservoir assembly 125 extends outside of cabinet 12, permitting access for adding treatment liquids to reservoir assembly 125. In this embodiment, reservoir assembly 125 does not extend through top surface 24, but rather at least a portion of reservoir assembly 125 extends through front panel 14 in at least the open position. In the embodiment of FIG. 6, reservoir assembly may further include a cover 146 that is attached to bottom surface 126, the one or more side walls 127, or both, either directly or indirectly. Cover 146 may extend outside of cabinet 12 when reservoir assembly is in the closed position (as well as when it is in the open position), providing users the ability to slide reservoir assembly 125 into the open position by pulling cover 146. Cover 146 may further abut against a portion of front panel 14 when reservoir assembly 125 is in the closed position, thus acting as a stop to prevent reservoir assembly 125 from being pushed further into cabinet 12.

Reservoir assembly 125 may also be in fluid communication with inlet 118 of impeller assembly 105. Specifically, a first fluid communication path 150 may have a first end 151 and second end 152, as shown in FIG. 2. First end 151 may be connected to reservoir assembly 125 at the outlet of siphon 129. Second end 152 may be connected to inlet 118 of impeller assembly 105, permitting fluid to travel from reservoir assembly 125 to impeller assembly 105. First fluid communication path 150 may take the form of a conduit or other tubing common in field.

In some embodiments, it may be desirable to control the timing of fluid flow from reservoir assembly 125. As shown in the alternative embodiment of FIG. 7, a valve 160, such as a solenoid valve, may be disposed within first fluid communication path 150 to control the flow of fluid through first fluid communication path 150. Valve 160 may be biased to the closed position, preventing fluid flow absent activation. Controller 84 may be configured to power valve 160 during only a portion of a drying cycle. For example, where the fluid used to treat articles of clothing or other laundry is a scent application, it may be desirable to limit the duration of time during which the scent is applied to provide over-scenting the articles. In such circumstances, controller 84 may activate valve 160 for a brief duration (e.g., 30 seconds) at the end of the drying cycle. Control over fluid distribution carries the additional benefit of conserving treatment materials.

Figure 7:
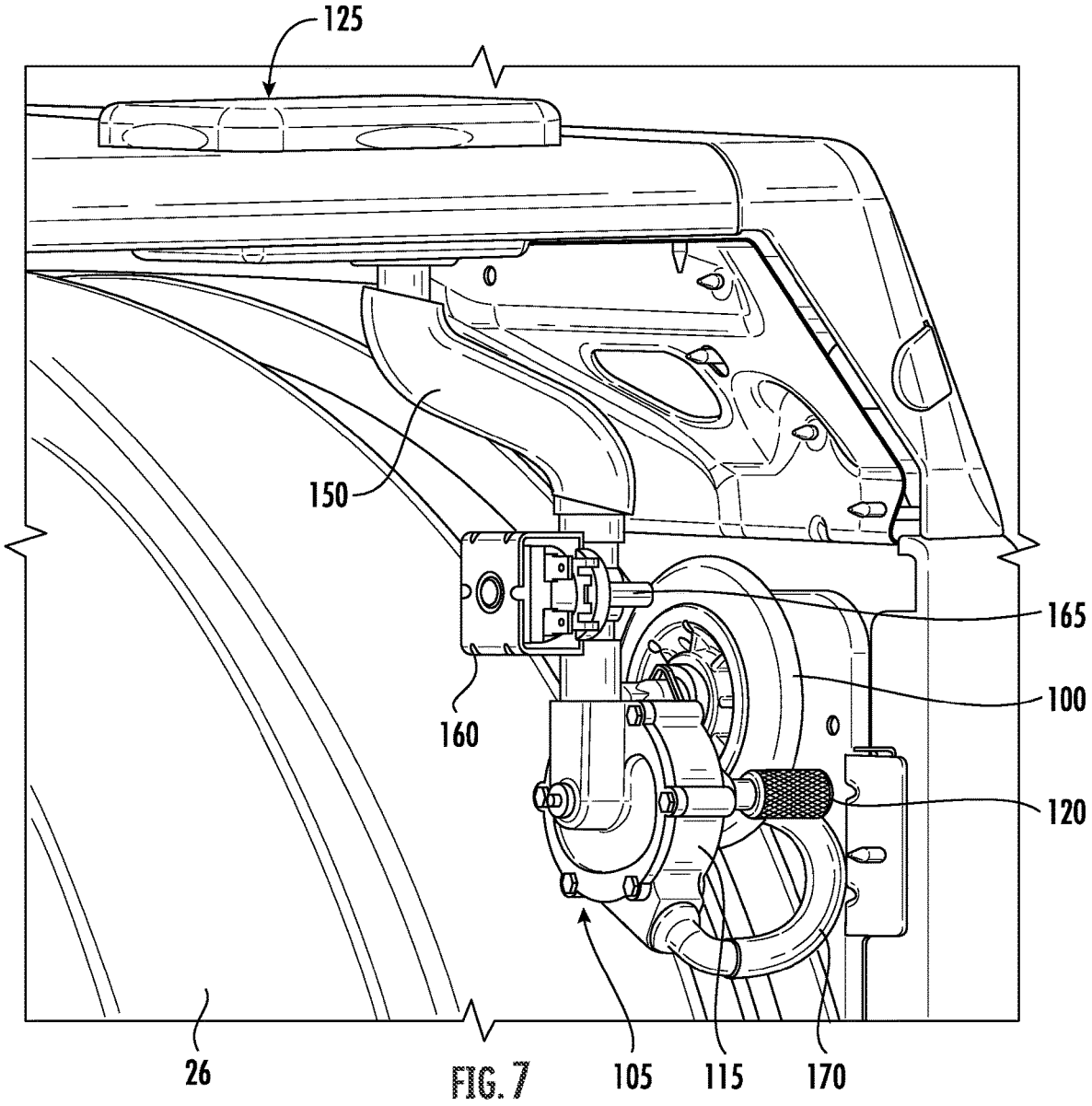
FIG. 7 provides a perspective view of portions of an exemplary dryer appliance in an alternative embodiment employing a valve and pressure relief line.

Embodiments employing valve 160 in first fluid communication path 150 further require a pressure relief line 165, as shown in the embodiment of FIG. 7. Pressure relief line 165, commonly referred to as a breather, may include a first end and a second end. The first end may be in fluid communication with first fluid communication path 150 and connected between valve 160 and inlet 118 of housing assembly 115. The second end of pressure relief line 165 may include an opening for the intake of ambient air. Thus, when valve 160 is closed and impeller assembly 105 operates, a vacuum is generated in fluid communication path 150. Pressure relief line 150 provides a source of air, preventing rupture or other damage to the components of fluid communication path 150 and/or valve 160.

Referring again to the embodiment of FIG. 3, dryer appliance 10 may further include a second fluid communication path 170. Second fluid communication path 170 may include a first end and a second end. The first end of second fluid communication path 170 may be connected to outlet 119 of impeller assembly 115. The second end of second fluid communication path 170 may connected to a fluid distribution element 175, thus providing a path for fluids to travel from impeller assembly 115 to fluid distribution element 175. Second fluid communication path 170 may take the form of a conduit or other tubing common in field. Fluid distribution element 175 directs fluids from reservoir assembly 125 into chamber 28 defined by drum 26 for treatment of clothing and other articles therein. In the embodiment of FIG. 3, fluid distribution element 175 is a nozzle. However, any known method for directing fluids may be employed. In certain embodiments, fluid distribution element 175 may not be a separate component from, for example, a conduit constituting second fluid communication path 170, but rather may simply be the end of opening of such conduit.

Considering the operation of dryer appliance 10 employing the components described herein, one of ordinary skill will recognize that rotation of drum 26 drives rotation of roller 100, spindle 120, and impeller 110. Rotation of impeller 110 creates a vacuum at and upstream of inlet 118, including in at least a portion of reservoir assembly 125 (assuming that valve 160 is absent or open). In embodiments for which reservoir assembly 125 includes siphon cap 130, treatment fluid added by the user during operation occupies a portion of the space between siphon cap 130 and siphon 129. Accordingly, the vacuum generated by rotation of impeller 110 draws the liquid through the hollow center of siphon 129, through first communication path 150, impeller assembly 105, second communication path 170, and fluid distribution element 175, where the fluid is directed into the dryer chamber 28 and applied to the articles tumbling therein. Alternatively, in embodiments for which reservoir assembly 125 lacks siphon cap 130, treatment fluid added by the user during operation is not drawn through siphon 129 by the application of a vacuum. Rather, the vacuum generated by rotation of impeller 110 draws gases present between the surface of the liquid and lid 140 through the hollow center of siphon 129, through first communication path 150, impeller assembly 105, second communication path 170, and fluid distribution element 175, where the fluid is directed into the dryer chamber 28 and applied to the articles tumbling therein. This latter application is particularly useful for providing a scent to articles in the dryer, where direct application of the scented treatment liquid is neither necessary nor desirable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:
a cabinet;
a rotatable drum within the cabinet, the rotatable drum defining a chamber for the receipt of articles for drying;
a rotatable roller in contact with the drum and oriented such that rotation of the drum causes rotation of the roller;
an impeller assembly comprising
an impeller;
a housing substantially enclosing the impeller, the housing having an inlet and an outlet, wherein rotation of the impeller generates negative pressure at the inlet and positive pressure at the outlet;
a spindle having a first end and a second end, the first end of the spindle in contact with the roller such that rotation of the roller causes rotation of the spindle, at least a portion of the second end of the spindle extending into the housing and attached to the impeller such that rotation of the spindle causes rotation of the impeller;
a reservoir assembly in fluid communication with the inlet of the housing of the impeller assembly wherein the reservoir assembly is connected to the inlet of the housing of the impeller assembly by a first fluid communication path and a valve is disposed within the first fluid communication path to control the flow of fluid through the first fluid communication path, the valve biased in a closed position, and the reservoir assembly further includes
a bottom surface;
one or more side surfaces extending vertically upward around a perimeter of the bottom surface to retain a liquid;
an opening in the bottom surface;
a hollow siphon attached to the bottom surface, at least a portion of the siphon extending vertically upward from the bottom surface, the siphon covering the opening such that fluids can flow from the reservoir, through the hollow siphon, and through the opening in the bottom surface of the reservoir assembly;
a siphon cap, the siphon cap having a top surface disposed above the siphon; and
one or more side surfaces extending downward from a perimeter of the top surface such that the one or more side surfaces extend around a portion of the siphon;
a fluid distribution element for dispensing fluid into the chamber, wherein the fluid distribution element is in fluid communication with the outlet of the housing of the impeller assembly; and
a pressure relief line having a first end and a second end, the first end in fluid communication with the first fluid communication path and connected between the valve and the inlet of the housing of the impeller assembly, the second end having an opening for the intake of ambient air.

2. The dryer appliance of claim 1, further comprising a controller, the controller configured to open the valve during at least a portion of a drying cycle.

3. The dryer appliance of claim 1, wherein the cabinet further comprises a top surface having a top surface opening for providing access to the reservoir assembly for adding fluids, the top surface further having a movable lid for selectively accessing the top surface opening.

4. The dryer appliance of claim 1, wherein the cabinet further comprises a front surface having a front surface opening and the reservoir assembly being movable between a closed position and an open position, at least a portion of the reservoir assembly being accessible from the front surface opening when the reservoir assembly is in the closed position and at least a portion of the reservoir assembly extending outside of the cabinet through the front surface opening when the reservoir assembly is in the open position to provide selective access to the reservoir assembly for adding liquid.

5. The dryer appliance of claim 1, further comprising a second fluid communication path having a first end and a second end, the first end of the second fluid communication path connected to the outlet of the housing of the impeller assembly, the second end of second fluid communication path connected to the fluid distribution element.

6. The dryer appliance of claim 5, wherein the fluid distribution element is a nozzle.

7. A dryer appliance comprising:
a cabinet;
a rotatable drum within the cabinet, the rotatable drum defining a chamber for the receipt of articles for drying;
a rotatable roller in contact with the drum and oriented such that rotation of the drum causes rotation of the roller;
an impeller assembly comprising
an impeller;
a housing substantially enclosing the impeller, the housing having an inlet and an outlet, wherein rotation of the impeller generates negative pressure at the inlet and positive pressure at the outlet;
a spindle having a first end and a second end, the first end of the spindle in contact with the roller such that rotation of the roller causes rotation of the spindle, at least a portion of the second end of the spindle extending into the housing and attached to the impeller such that rotation of the spindle causes rotation of the impeller; and
a reservoir assembly in fluid communication with the inlet of the housing of the impeller assembly wherein the reservoir assembly comprises a lid disposed on top of the one or more side surfaces and further comprises a check valve disposed in the lid, the reservoir assembly comprising
a bottom surface;
one or more side surfaces extending vertically upward around a perimeter of the bottom surface to retain a liquid;
an opening in the bottom surface; and
a hollow siphon attached to the bottom surface, at least a portion of the siphon extending vertically upward from the bottom surface, the siphon covering the opening such that fluids can flow from the reservoir assembly, through the hollow siphon, and through the opening in the bottom surface of the reservoir assembly.

8. The dryer appliance of claim 7, wherein the reservoir assembly is connected to the inlet of the housing of the impeller assembly by a first fluid communication path and a valve is disposed within the first fluid communication path to control the flow of fluid through the first fluid communication path, the valve biased in a closed position.

9. The dryer appliance of claim 8, further comprising a controller, the controller configured to open the valve during at least a portion of a drying cycle.

10. The dryer appliance of claim 8, further comprising a pressure relief line having a first end and a second end, the first end in fluid communication with the first fluid communication path and connected between the valve and the inlet of the housing of the impeller assembly, the second end having an opening for the intake of ambient air.

11. The dryer appliance of claim 7, wherein the cabinet further comprises a top surface having a top surface opening, at least a portion of the reservoir assembly extending through the top surface opening, and the lid of the reservoir assembly being movable for selectively accessing and adding liquid to the reservoir assembly.

12. The dryer appliance of claim 7, wherein the cabinet further comprises a front surface having a front surface opening and the reservoir assembly being movable between a closed position and an open position, at least a portion of the reservoir assembly being accessible from the front surface opening when the reservoir assembly is in the closed position and at least a portion of the reservoir assembly extending outside of the cabinet through the front surface opening when the reservoir assembly is in the open position to provide selective access to the reservoir assembly for adding liquid.

13. The dryer appliance of claim 7, wherein the dryer appliance further comprises a nozzle for dispensing fluid into the chamber, wherein the nozzle is in fluid communication with the outlet of the housing of the impeller assembly.

14. The dryer appliance of claim 13, further comprising a second fluid communication path having a first end and a second end, the first end of the second fluid communication path connected to the outlet of the housing of the impeller assembly, the second end of second fluid communication path connected to the nozzle.

15. The dryer appliance of claim 7 wherein the siphon lacks a siphon cap.

16. The dryer appliance of claim 15 wherein the fluid flowing from the reservoir assembly and through the hollow siphon is a gaseous fluid.

17. The dryer appliance of claim 16, wherein the reservoir assembly is connected to the inlet of the housing of the impeller assembly by a first fluid communication path and a valve is disposed within the first fluid communication path to control the flow of fluid through the first fluid communication path, the valve biased in a closed position.

18. The dryer appliance of claim 17, further comprising a pressure relief line having a first end and a second end, the first end in fluid communication with the first fluid communication path and connected between the valve and the inlet of the housing of the impeller assembly, the second end having an opening for the intake of ambient air.

19. The dryer appliance of claim 18, further comprising a second fluid communication path having a first end and a second end, the first end of the second fluid communication path connected to the outlet of the housing of the impeller assembly, the second end of second fluid communication path connected to a fluid distribution element.

* * * * *